US007694381B2

(12) United States Patent
Heaslet

(10) Patent No.: US 7,694,381 B2
(45) Date of Patent: Apr. 13, 2010

(54) HAND TOOL FOR REMOVAL OF WAX FROM A SURFBOARD INCORPORATING MANUAL ACCESSORIES

(76) Inventor: Joey Heaslet, 925 St Mary Ave., Cayucos, CA (US) 93430

( * ) Notice: Subject to any disclaimer, the term of this patent is extended or adjusted under 35 U.S.C. 154(b) by 988 days.

(21) Appl. No.: 11/443,965

(22) Filed: May 30, 2006

(65) Prior Publication Data

US 2007/0277336 A1 Dec. 6, 2007

(51) Int. Cl.
*A47L 13/02* (2006.01)

(52) U.S. Cl. ..... 15/236.08; 15/236.05; 15/105

(58) Field of Classification Search ..... 15/105, 15/236.05, 236.08, 216, 236.01; 7/151, 120, 7/165; 76/83, 88, 89.1
See application file for complete search history.

(56) References Cited

U.S. PATENT DOCUMENTS 3,061,927 A * 11/1962 Von Frankenberg Und Ludwigsdorf ..... 30/156
4,659,498 A 4/1987 Stoufer
4,856,132 A * 8/1989 Burns et al. ..... 7/118
4,905,338 A 3/1990 Mascia
5,007,129 A * 4/1991 Hainey ..... 15/236.08
5,219,238 A 6/1993 Hainbach
5,787,535 A * 8/1998 Epstein ..... 7/118
7,343,639 B2 * 3/2008 Dranginis et al. ..... 15/236.02
2005/0278866 A1 * 12/2005 Madarieta ..... 7/120

* cited by examiner

*Primary Examiner*—Dung Van Nguyen
(74) *Attorney, Agent, or Firm*—Michael A. Painter

(57) ABSTRACT

A hand tool used for removing wax from a surfboard incorporating associated accessories. The wax removal element of the present invention constitutes a substantially rectangular scraping panel that can be resiliently flexed along the elongated axis of the panel. One of the elongated edges of the panel is extended into a plurality of uniform gouging members that are adapted to penetrate the wax to prepare the wax mounted on the surfboard to be removed. The edge of the panel opposed to the scraping members is beveled to provide an edge that is adapted to remove the wax from the surfboard. Rotatably coupled to the bottom surface of the scraping panel are one or more accessories and hand tools used for maintenance of the surfboard and for the personal employment of the user.

15 Claims, 3 Drawing Sheets

HAND TOOL FOR REMOVAL OF WAX FROM A SURFBOARD INCORPORATING MANUAL ACCESSORIES

BACKGROUND OF THE INVENTION

1. Field of the Invention

The present invention generally relates to a hand tool for performing maintenance on a surfboard and in particular a hand tool for removing wax from a surfboard incorporating accessories for additional surfboard maintenance.

2. Description of the Prior Art

It is common to coat a surface of a surfboard with wax. Wax can either be applied manually or by melting the wax. Under either circumstance, the tools disclosed by the prior art to remove the wax are complex, are easily broken or otherwise fail to perform their intended function.

The prior art discloses hand held blade-type scrapers to remove wax from surfboards and other like surfaces. Often the scraper is simply a generally rectangular metal or plastic plate having one or more relatively sharp edges. While this tool is adequate for skis that have flat surfaces, it is unusable for surfboards that are constructed with curved surfaces to minimize drag in water. The present invention resolves this problem by providing a substantially rectangular scraping panel that can adapt to the curvature of the surfboard.

The present invention substantially resolves the inadequacies of the hand tools disclosed in the prior art. A flexible scraping panel incorporates means for loosening the wax that may be hardened on the surface of a surfboard and a second beveled surface for removing the wax. The flexibility of the scraper along an axis thereof permits the tool to adapt to the curvature of the surfboard. To provide ease of use and efficiency, hand tools and accessories used for the maintenance of surfboards or for personal use by the user are rotatably coupled to the scraping panels. The tools can include a fin-key adapted to remove a fin from a surfboard, a screwdriver and an accessory mounting plate that can employ personal accessories such as a bottle opener.

SUMMARY OF THE INVENTION

The present invention comprises a hand tool to remove wax from surfboards and incorporates additional accessories and hand tools used for surfboard maintenance and the needs of the user. The base element of the present invention comprises a substantially rectangular scraping panel constructed of flexible material that will permit the panel to be resiliently deformed along its longitudinal axis. The flexibility is required to adapt the scraping panel to the curvature of the surfboard. A plurality of scraping members extend outwardly from one of the longitudinal edges of the scraping panel. The scraping members are typically uniform teeth that are sufficiently sharpened to weaken or otherwise prepare hardened wax disposed on the surface of the surfboard. The longitudinal surface of the scraping panel opposite the scraping member is beveled to provide an edge to undercut the prepared wax and remove same from the surface of the surfboard. The flexibility of the scraping panel to permit it to bend along the longitudinal axis will permit the user to apply the beveled edge uniformly along curved surfaces of the surfboard.

An accessory panel is rotatably coupled to the scraping panel. The accessory panel is a planar member adapted to be positioned adjacent the bottom surface of the scraping panel. The accessory panel is substantially square. At the interface at two of the edges of the accessory panel, one or more accessories are rotatably coupled thereto. When not in use, the tool or tools are rotated to align within the edges of the accessory panel. As a further enhancement, an aperture is disposed within the center of the accessory panel into which opposing ridges are disposed that will permit the user to remove conventional caps from bottles.

It is therefore an object of the present invention to provide an improved hand tool for removing wax from a surfboard.

It is another object of the present invention to provide a wax removing tool for a surfboard incorporating maintenance accessories.

It is still another object of the present invention to provide a hand tool for removing wax from a surfboard that incorporates additional maintenance tools that can be folded for easy storage.

It is still yet another object of the present invention to provide an improved hand tool for performing maintenance on a surfboard that is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DESCRIPTION OF THE PRESENTLY PREFERRED EMBODIMENT

Figure 1:
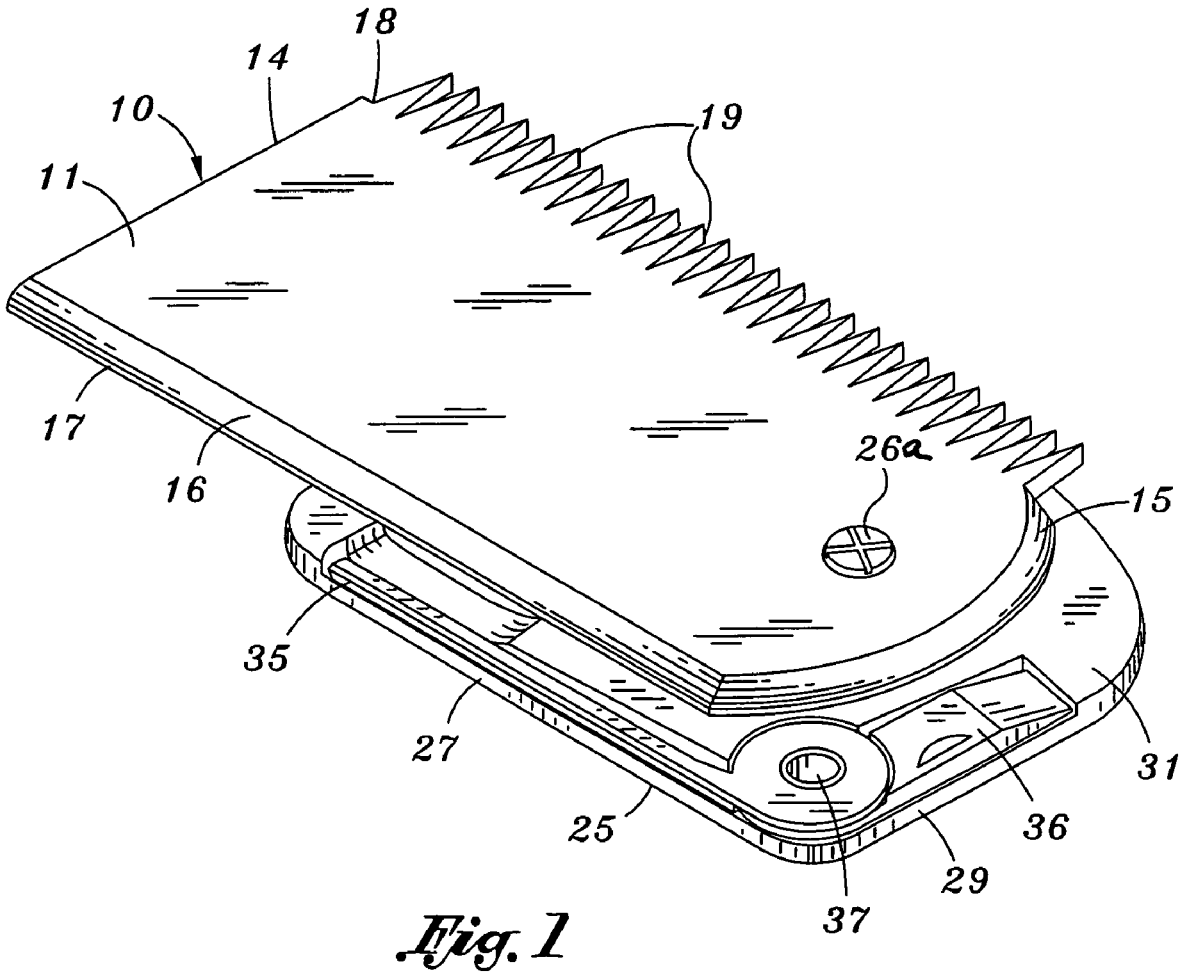
FIG. 1 illustrates a perspective view of the present invention hand tool for the removal of wax from a surfboard illustrating the incorporated accessory panel in a folded storage position.
Figure 2:
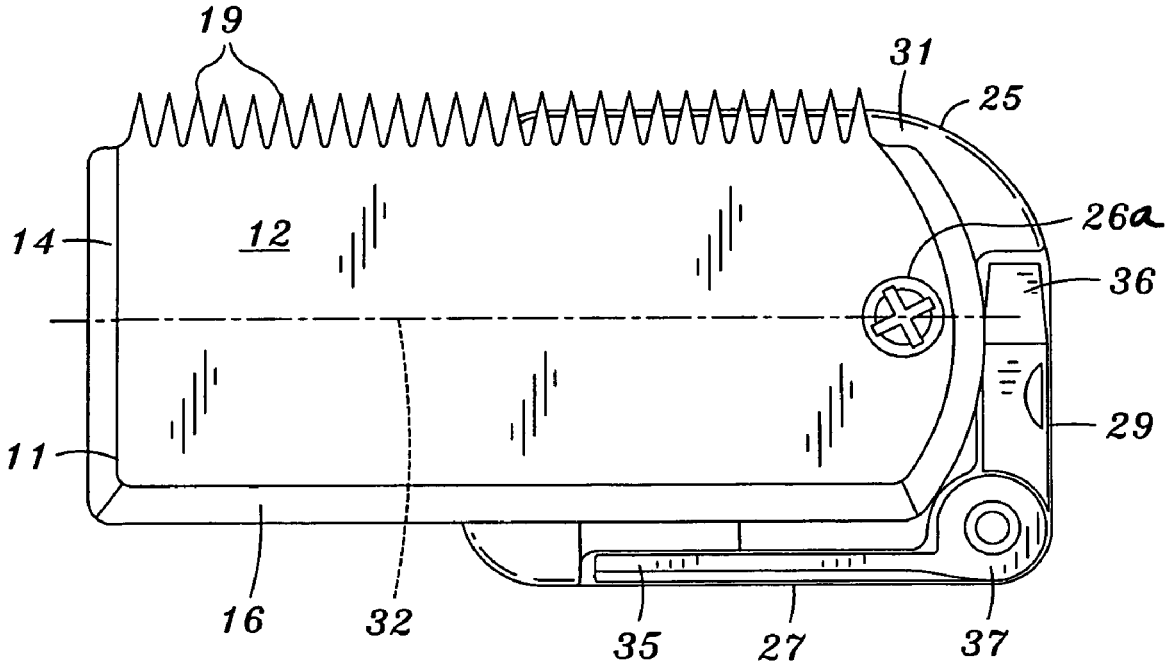
FIG. 2 illustrates a top plan view of the present invention hand tool shown in FIG. 1.
Figure 3:
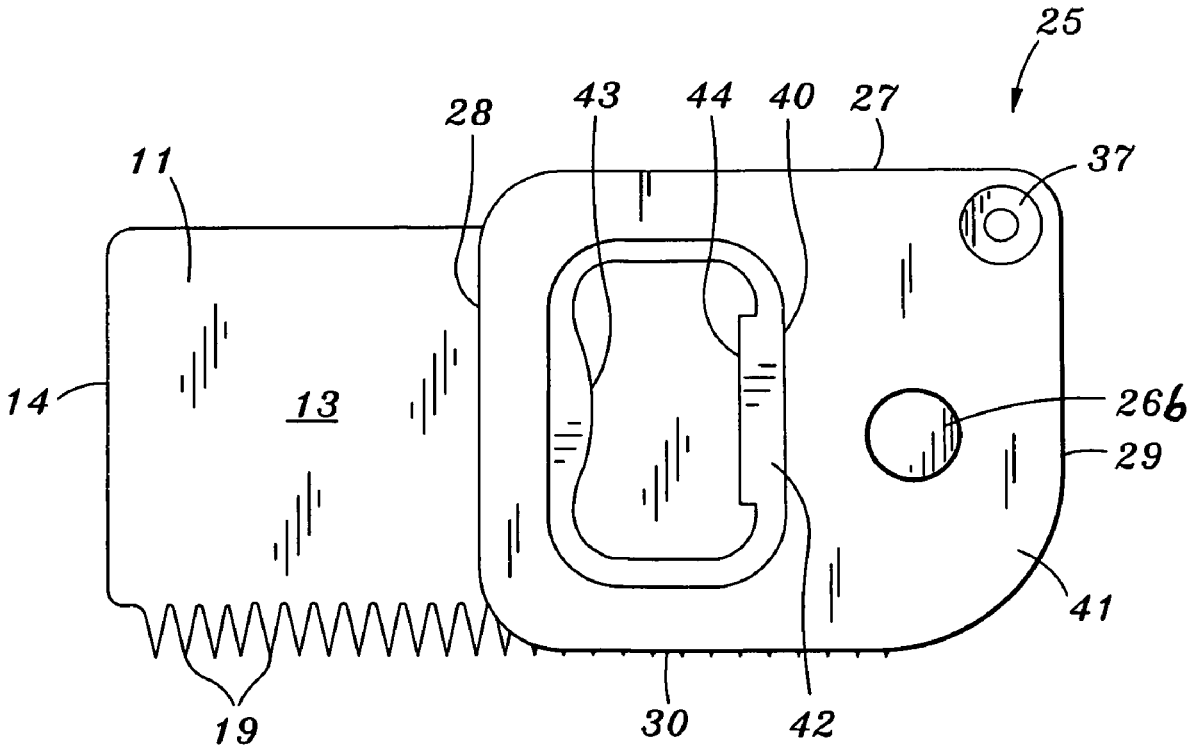
FIG. 3 illustrates a bottom plan view of the present invention hand tool shown in FIG. 1.
Figure 4:
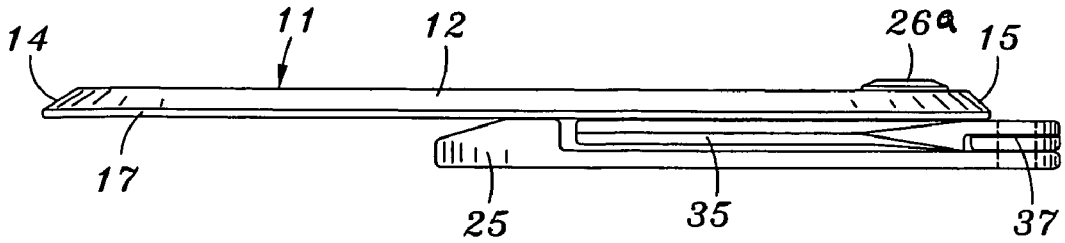
FIG. 4 illustrates a side elevation view of the present invention hand tool incorporating manual accessories in the folded position.
Figure 5:
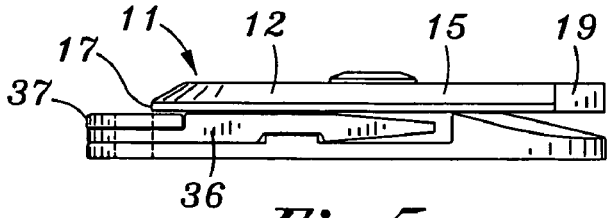
FIG. 5 is an end view of the present invention hand tool illustrating the incorporated manual accessories in a folded position.

An understanding of the present invention surfboard hand tool can be best understood by reference to FIGS. 1-5, inclusive, the surfboard hand tool being generally designated by the reference numeral 10. Hand tool 10 comprises a flexible, scraping panel 11 that is generally rectangular in orientation. Scraping panel 11 includes a top surface 12, bottom surface 13 and opposed ends 14 and 15. The thickness of scraping panel 11 is defined by the distance between top and bottom surfaces 12 and 13. The thickness of scraping panel 11 is sufficient to allow it to be resiliently flexed along its horizontal axis 32 and to permit a first longitudinal edge 16 to be beveled outwardly from the top surface 12 to the bottom surface 13.

To avoid damage to scraping panel 11 during use, the beveled edges 14 and 16 define a band 17 that is perpendicular to top and bottom surfaces 12 and 13. Band 17 is small enough to permit beveled edge to effectively remove wax from the surfboard yet be broad enough to prevent inadvertent damage during use. The longitudinal edge 18 opposed to beveled edge 16 is extended outwardly into a plurality of uniform gouging or scraping members 19. Gouging members 19 each comprise a V-shaped tooth tapered into a sharpened point that will permit the wax on the surfboard to be broken up or otherwise prepared for removal.

To meet the objectives of the present invention, accessory panel 25 is rotatably coupled about pivot pin elements 26*a* and 26*b* disposed through scraping panel 11 along the longitudinal axis 32 of scraping panel 11. In the preferred embodiment of the present invention, pivot pin elements 26*a*, 26*b* comprise axially aligned mating elements that may be detached from one another to separate accessory panel 25 from scraping panel 11 and be recoupled to one another to facilitate storage. It is understood that the objectives of the present invention may be met by a non-detachable pivot pin to pivotally couple accessory panel 25 to scraping panel 11. Accessory panel 25 is generally square in orientation and is defined by opposing edges 27, 28, 29 and 30. Accessory panel 25 is generally a planar member having an upper surface 31 that is adapted to be positioned adjacent bottom surface 13 when accessory panel 25 is in the closed position shown in FIG. 2.

Figure 6:
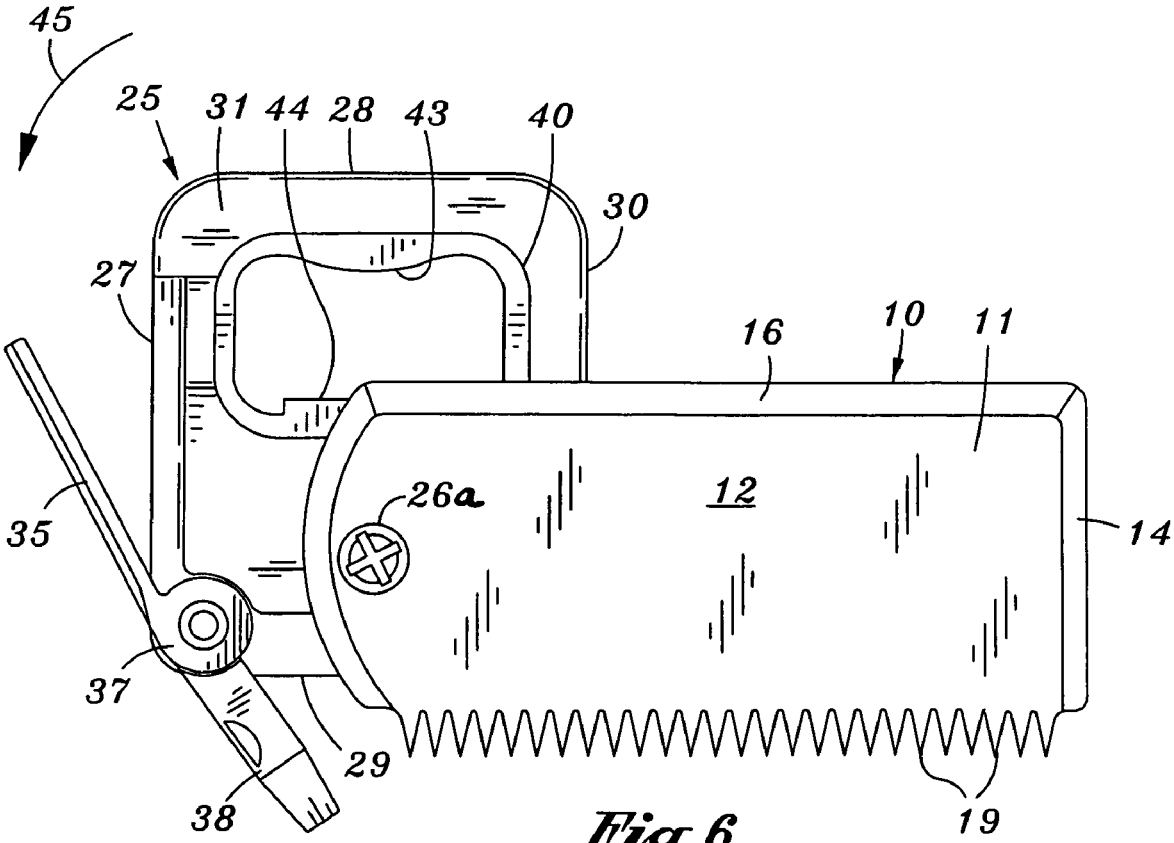
FIG. 6 is a top plan view of the present invention hand tool illustrating the incorporated accessory panel and accessories in an opened position.

As shown best in FIG. 6, at the interface of edges 27 and 29 of accessory panel 25, a pair of surfboard maintenance tools 35 and 36 are rotatably coupled to accessory panel 25 by a pivot pin 37 disposed through accessory panel 25. The preferred embodiment of the present invention illustrates the incorporation of a fin-key 35 and a screwdriver 36 which are independently rotatable about pivot pin 37. Although the preferred embodiment of the present invention is illustrated through the use of coupled accessories defined by fin-key 35 and screwdriver 36, it is understood by those having skill in the art that other conventional maintenance tools could be substituted therefor.

An objective of the present invention is to provide an accessory panel that can also provide an platform for uses other than mounting a maintenance tool. As can be best seen in FIG. 3, an aperture 40 is disposed through accessory panel 25 from the top surface 31 for the bottom surface 41 of accessory panel 25. In the preferred embodiment, an insert frame 42 having opposed gripping faces 43 and 44 are coupled within aperture 40 to provide means for opening containers having conventional bottle caps. It is understood by persons having skill in the art that other conventional maintenance tools or accessories could be coupled to accessory panel 25 in lieu of bottle opening surfaces 43 and 44.

The operation of the present invention can be best seen by reference to FIG. 6. In FIG. 6, accessory panel 25 is rotated counterclockwise in a manner depicted by reference numeral 45. Rotating accessory panel 25 90° from the closed position in the manner shown in FIG. 6 will provide access to both pin-key 35 and screwdriver 36. By rotating accessory panel 25 an additional 90° counterclockwise from the position that shown in FIG. 6, aperture 40 will be positioned for use of the bottle opening surfaces 43 and 44. When accessory panel 25 is rotated to expose the full length of beveled edge 16, scraping members 19 and beveled edge 16 can be employed to prepare and remove wax from the surfboard surfaces.

I claim:

1. A surfboard hand tool comprising:

(a) a resilient, elongated planar wax scraping panel having top and bottom surfaces in parallel spaced relation to one another and first and second opposed elongated edges, said first edge depending into a scraping edge beveled outwardly from the top surface toward the bottom surface of said panel, said second edge extending outwardly into wax gouging means for penetrating hardened wax on the surfboard;

(b) an accessory panel having top and bottom surfaces in parallel spaced relation to each other and having two pairs of intersecting, opposing edges, said accessory panel being pivotally coupled to said scraping panel, the top surface of said accessory panel being in slidable contact with the bottom surface of said scraping panel; and (c), at least one surfboard accessory tool being pivotally coupled to said accessory panel at the interface between adjacent edges of the accessory panel along the top surface thereof, said surfboard accessory tool being pivotable between a closed and opened position and being adapted to be in slidable contact with the top surface of the accessory panel when in the closed position.

2. A surfboard hand tool as defined in claim 1 wherein said first and second edges of said scraping panel are in substantially parallel spaced relation to each other, said scraping panel being resiliently flexible along an axis intermediate the first and second edges thereof.

3. A surfboard hand tool as defined in claim 1 wherein an aperture is disposed in said accessory panel from the top surface to the bottom thereof, means for removing a cap from a bottle being mounted within said aperture.

4. A surfboard hand tool as defined in claim 1 wherein the beveled scraping edge is terminated at a band perpendicular to the top and bottom surfaces of said scraping panel whereby inadvertent damage to the beveled scraping edge is prevented.

5. A surfboard hand tool as defined in claim 1 wherein said gouging means comprises a plurality of uniformly spaced members each being tapered outwardly to a pointed terminus.

6. A surfboard hand tool as defined in claim 1 wherein the surfboard accessory tool is a fin-key.

7. A surfboard hand tool as defined in claim 5 wherein said scraping panel includes first and second end surfaces extending between opposite ends of said scraping edge and said gouging means, said first and second ends being beveled outwardly from the top surface toward the bottom surface of said scraping panel terminating at a band perpendicular to the top and bottom surfaces of said scraping panel.

8. A surfboard hand tool as defined in claim 1 wherein said accessory panel is pivotally coupled to the scraping panel by axially aligned detachable elements.

9. A surfboard hand tool comprising:

(a) a resilient, elongated planar wax scraping panel having top and bottom surfaces in parallel spaced relation to one another and first and second opposed elongated edges, said first edge depending into a scraping edge beveled outwardly from the top surface toward the bottom surface of said panel, said second edge extending outwardly into wax gouging means for penetrating hardened wax on the surfboard;

(b) an accessory panel having top and bottom surfaces in parallel spaced relation to each other and having two pairs of intersecting, opposing edges, said accessory panel being pivotally coupled to said scraping panel, the top surface of said accessory panel being in slidable contact with the bottom surface of said scraping panel; and (c) first and second accessory tools coupled about a shaft connected to said accessory panel at the interface between adjacent edges of the accessory panel along the top surface thereof, said accessory tools being independently pivotable with respect to each other and being pivotable between a closed and opened position whereby said first and second accessory tools are each adapted to be in slidable contact with the top surface of the accessory panel when in the closed position.

10. A surfboard hand tool as defined in claim 9 wherein said first and second edges of said scraping panel are in substantially parallel spaced relation to each other, said scraping panel being resiliently flexible along an axis intermediate the first and second edges thereof.

11. A surfboard hand tool as defined in claim 9 wherein an aperture is disposed in said accessory panel from the top surface to the bottom thereof, means for removing a cap from a bottle being mounted within said aperture.

12. A surfboard hand tool as defined in claim 9 wherein the beveled scraping edge is terminated at a band perpendicular to the top and bottom surfaces of said scraping panel whereby inadvertent damage to the beveled scraping edge is prevented.

13. A surfboard hand tool as defined in claim 9 wherein said gouging means comprises a plurality of uniformly spaced members each being tapered outwardly to a pointed terminus.

14. A surfboard hand tool as defined in claim 9 wherein said first accessory tool is a fin-key.

15. A surfboard hand tool as defined in claim 9 wherein said accessory panel is pivotally coupled to the scraping panel by axially aligned detachable elements.

* * * * *